US008252736B2

(12) United States Patent
Brooker et al.

(10) Patent No.: US 8,252,736 B2
(45) Date of Patent: Aug. 28, 2012

(54) CLEANING COMPOSITION

(75) Inventors: Anju Deepali Massey Brooker, Newcastle upon Tyne (GB); Weihua Lan, Newcastle upon Tyne (GB); Dan Xu, Newcastle upon Tyne (GB); Alberto Martinez-Becares, Newcastle upon Tyne (GB); David William York, Newcastle upon Tyne (GB)

(73) Assignee: The Procter & Gamble Company, Cincinatti, OH (US)

( * ) Notice: Subject to any disclaimer, the term of this patent is extended or adjusted under 35 U.S.C. 154(b) by 0 days.

(21) Appl. No.: 12/553,338

(22) Filed: Sep. 3, 2009

(65) Prior Publication Data

US 2010/0075885 A1 Mar. 25, 2010

(30) Foreign Application Priority Data

Sep. 23, 2008 (EP) ..... 08164925

(51) Int. Cl.

| | |
|---|---|
| ***C11D 3/02*** | (2006.01) |
| ***C11D 3/12*** | (2006.01) |
| ***C11D 3/37*** | (2006.01) |
| ***C11D 3/386*** | (2006.01) |
| ***C11D 17/04*** | (2006.01) |
| ***B08B 9/20*** | (2006.01) |

(52) U.S. Cl. ..... 510/220; 510/221; 510/226; 510/229; 510/392; 510/393; 510/435; 510/439; 510/475; 510/507; 134/25.2

(58) Field of Classification Search ..... 510/220, 510/226, 221, 229, 392, 393, 435, 439, 475, 510/507; 134/25.2

See application file for complete search history.

(56) References Cited

U.S. PATENT DOCUMENTS

| | | | | | |
|---|---|---|---|---|---|
| 3,812,044 | A | | 5/1974 | Connor et al. | |
| 3,929,678 | A | | 12/1975 | Laughlin | |
| 4,105,827 | A | | 8/1978 | Brichard et al. | |
| 4,259,217 | A | | 3/1981 | Murphy | |
| 4,704,233 | A | | 11/1987 | Hartman et al. | |
| 4,760,025 | A | | 7/1988 | Estell et al. | |
| 4,810,410 | A | | 3/1989 | Diakun et al. | |
| 5,114,611 | A | | 5/1992 | Van Kralingen et al. | |
| 5,227,084 | A | | 7/1993 | Martens et al. | |
| 5,256,328 | A | * | 10/1993 | Cavanagh et al. | 510/191 |
| 5,288,627 | A | | 2/1994 | Nielsen et al. | |
| 5,364,550 | A | * | 11/1994 | Manzo et al. | 510/303 |
| 5,453,216 | A | | 9/1995 | Kellett | |
| 5,510,048 | A | * | 4/1996 | Durbut et al. | 510/223 |
| 5,534,198 | A | * | 7/1996 | Masters et al. | 510/182 |
| 5,576,281 | A | | 11/1996 | Bunch et al. | |
| 5,679,630 | A | | 10/1997 | Baeck et al. | |
| 5,766,371 | A | | 6/1998 | Bunch et al. | |
| 5,856,164 | A | | 1/1999 | Outtrup et al. | |
| 5,964,692 | A | | 10/1999 | Blezard et al. | |
| 6,211,134 | B1 | | 4/2001 | Caldwell et al. | |
| 6,312,936 | B1 | | 11/2001 | Poulose et al. | |
| 6,599,871 | B2 | | 7/2003 | Smith | |
| 6,605,583 | B1 | | 8/2003 | Gorlin | |
| 6,660,713 | B2 | * | 12/2003 | Carter et al. | 510/507 |
| 6,673,589 | B2 | | 1/2004 | Borchert et al. | |
| 6,727,215 | B2 | | 4/2004 | Roberts et al. | |
| 6,867,031 | B2 | | 3/2005 | Bisgard-Frantzen et al. | |
| 6,979,731 | B1 | | 12/2005 | Hatada et al. | |
| 7,087,662 | B2 | * | 8/2006 | Ghosh et al. | 523/223 |
| 7,153,818 | B2 | | 12/2006 | Breves et al. | |
| 7,566,561 | B2 | | 7/2009 | Svendsen et al. | |
| 2002/0065208 | A1 | | 5/2002 | Aubay et al. | |
| 2002/0108640 | A1 | | 8/2002 | Barger et al. | |
| 2002/0172773 | A1 | * | 11/2002 | Ghosh et al. | 427/372.2 |
| 2002/0197698 | A1 | | 12/2002 | Hagihara et al. | |
| 2004/0259749 | A1 | | 12/2004 | Braeckman et al. | |
| 2005/0170487 | A1 | | 8/2005 | Svendsen et al. | |
| 2005/0241667 | A1 | | 11/2005 | Bodet et al. | |
| 2005/0255152 | A1 | * | 11/2005 | Edwards et al. | 424/450 |
| 2006/0128585 | A1 | * | 6/2006 | Adair et al. | 510/383 |
| 2007/0249513 | A1 | | 10/2007 | Mort et al. | |
| 2008/0063774 | A1 | | 3/2008 | Aehle et al. | |
| 2008/0193999 | A1 | | 8/2008 | Andersen et al. | |
| 2008/0209863 | A1 | | 9/2008 | Catlin et al. | |
| 2008/0293610 | A1 | | 11/2008 | Shaw et al. | |
| 2008/0296196 | A1 | | 12/2008 | Duffield et al. | |
| 2009/0082242 | A1 | * | 3/2009 | Brooker et al. | 510/220 |
| 2009/0082243 | A1 | * | 3/2009 | Brooker et al. | 510/220 |
| 2010/0062965 | A1 | * | 3/2010 | Brueckner et al. | 510/433 |

FOREIGN PATENT DOCUMENTS

| | | | | |
|---|---|---|---|---|
| DE | 101007011491 | A | * | 9/2008 |
| EP | 1837394 | A1 | * | 9/2007 |
| WO | WO 93/08876 | A1 | | 5/1993 |
| WO | WO 94/02597 | A1 | | 2/1994 |
| WO | WO 01/00779 | A1 | | 1/2001 |
| WO | WO 02/061027 | A1 | | 8/2002 |
| WO | WO 02/064877 | A1 | | 8/2002 |
| WO | WO 2007/054126 | A1 | | 5/2007 |
| WO | WO 2007/109327 | A1 | | 9/2007 |

OTHER PUBLICATIONS

International Search Report, 7 Pages, PCT/US2009/057604 mailed on Jan. 25, 2010.
U.S. Appl. No. 12/553,356, filed Sep. 3, 2009, Booker et al.
U.S. Appl. No. 12/553,387, filed Sep. 3, 2009, Booker et al.

* cited by examiner

*Primary Examiner* — Lorna M Douyon
(74) *Attorney, Agent, or Firm* — Tiffany A Zerby; Leonard W Lewis; Julie A McConihay

(57) ABSTRACT

An alkaline cleaning composition for use in aqueous medium comprising nanoparticles or a nanoparticles precursor and a polymeric nanoparticle stabilizer.

17 Claims, No Drawings

CLEANING COMPOSITION

This application contains a sequence listing, described hereinafter, which is represented by a paper copy of the sequence listing attached, which is hereby incorporated by reference herein.

TECHNICAL FIELD

The present invention is in the field of cleaning, in particular it relates to cleaning compositions comprising nanoparticles or a nanoparticle precursor. The invention also relates to a method of cleaning using compositions comprising nanoparticles.

BACKGROUND OF THE INVENTION

In the field of automatic dishwashing the formulator is constantly looking for improved and simplified cleaning compositions and methods. There is a need for finding compositions having a more environmentally friendly profile, i.e. using more environmentally friendly ingredients, reducing the number of ingredients, reducing the amount needed for achieving good cleaning and being more effective than current compositions.

Cleaning compositions comprising nanoparticles are known in the art. Nanoparticles present serious stability issues when placed in a wash liquor (aqueous medium). Nanoparticles have a substantial fraction of their atoms or molecules at the surface. When placed in an aqueous medium, an interface exists between the surface of the particles and the carrier liquid. The behaviour of the resultant dispersion, including stability, is mainly determined by how this surrounding interface interacts with the surface of the nanoparticles and the carrier liquid.

Solutions, unlike nanoparticulate dispersions or suspensions, lack an identifiable interface between their solubilized molecules and the solvent. In solutions, the solubilized molecules are in direct contact with the solvent, while in dispersions only the surface of the nanoparticles are in direct contact with the carrier liquid. Hence, the carrier liquid does not solubilize the particles that make up a dispersion; instead, the carrier liquid "carries" the particles; by carrying the particles, a suspension or dispersion results. The terms "suspension" and "dispersion" are herein used interchangeably.

The interfaces between the suspended nanoparticles, and the carrier liquid or liquid mixture in which they reside, play a dominant role in determining the behaviour and capabilities of the nanoparticle dispersion. Suspensions are considered stable if the nanoparticles are separated or deflocculated, i.e., not aggregated or flocculated.

An objective of the present invention is to provide a cleaning composition comprising nanoparticles capable of forming a stable dispersion in a cleaning medium (or wash liquor), preferably in an aqueous wash liquor. The terms "cleaning medium" and "wash liquor" are herein used interchangeably.

Another problem related to compositions comprising nanoparticles is that the nanoparticles can interact with other components of the composition in the aqueous cleaning medium, thereby reducing its cleaning activity. This interaction is particularly detrimental in the case of protease enzymes. Thus another objective of this invention is to provide cleaning compositions comprising nanoparticles and at the same time having a high protease activity.

SUMMARY OF THE INVENTION

According to the first aspect of the present invention, there is provided an alkaline cleaning composition, i.e. a composition having a pH greater than 7, preferably from about 8 to about 12 and more preferably from about 9 to about 11 as measured at 1% by weight in aqueous solution at 20° C.

The composition of the invention is for use in an aqueous medium, i.e. for dissolving/dispersing the composition in water, usually tap water, to form a wash liquor. The wash liquor can be applied onto the surface to be cleaned but preferably, the surface is cleaned by immersion into the wash liquor.

The cleaning composition of the invention is suitable for use on any type of surfaces, in particular hard surfaces. The composition is especially suitable for use in automatic dishwashing.

The composition of the invention provides excellent cleaning of hard surfaces, even in the absence of, or using low levels of traditional cleaning ingredients such as builders and surfactants. In particular, the composition of the invention provides outstanding cleaning when used in automatic dishwashing, including first time cleaning, even of tough soils such as cooked-, baked- and burnt-on soils, second time cleaning and finishing, including shine, glass and metal care.

By "nanoparticles" herein are meant particles, preferably inorganic particles, having a particle size of from about 1 nm to about 500 nm, preferably from about 5 nm to about 400 nm, more preferably from about 10 to about 100 nm, and especially from about 15 to about 60 nm. The particle size can be measured using a Malvern zetasizer instrument as detailed herein below. The particle size referred to herein is the z-average diameter, an intensity mean size. Preferably, the nanoparticles for use in the composition of the invention are inorganic nanoparticles, more preferably clays (sometimes referred herein as "nanoclays") and specially preferred synthetic nanoclays, such as those supplied by Rockwood Additives Limited under the Laponite trademark.

The cleaning composition of the invention comprises nanoparticles or a nanoparticle precursor, where the nanoparticle precursor is a secondary particle which releases nanoparticles when introduced into a wash liquor. By "nanoparticle precursor" is herein meant a secondary particle (the term "secondary particle" includes aggregates) being able to generate nanoparticles when 0.2 g of the precursor is added to 1l of water having a pH of 10.5 (KOH being the alkalising agent) at 20° C. and stirred at 500 rpm for 30, preferably for 15 and more preferably for 5 minutes.

The present inventors have found that nanoparticles should be dispersed in the cleaning medium to provide optimum cleaning and care benefits. The aqueous medium is usually tap water. Tap water usually contains hardness ions, the amount and type of ions varies from one geographic area to another. Nanoparticle dispersions can be easily destabilized by hardness ions and they can give rise to flocculation and precipitation of the nanoparticles. This not only impairs the cleaning capacity of the nanoparticles but might also contribute to soiling of the surfaces to be cleaned.

It is believed that the nanoparticles of the cleaning composition of the invention are kept dispersed in aqueous medium by means of the formation of a core-shell structure with the nanoparticle stabilizer. The nanoparticles can be kept dispersed in aqueous medium independently of the amount of hardness ions present in the water. A "polymeric nanoparticle stabilizer" is capable of maintaining the nanoparticle stabilized as single particles, i.e. avoiding the formation of aggregates, under cleaning conditions.

By "polymeric nanoparticle stabilizer" is herein meant a polymer capable of maintaining nanoparticles dispersed in an aqueous solution in the presence of calcium, i.e. preventing aggregation. A detailed method to evaluate whether a polymer falls into the definition of nanoparticle stabilizer is provided herein below. The particle size of nanoparticles in an aqueous solution at a certain pH (pH 10.5) is measured (this particle size is referred herein as original particle size) and compared with the particle size of the nanoparticles in the presence of calcium and the polymeric nanoparticle stabilizer (this particle size is referred herein as modified particle size) at the same pH. If the modified particle size is less than 5, preferably less than 4, more preferably less than 3 and especially less than 2 times that of the original particle size, then the polymer is considered a nanoparticle stabilizer according to this invention.

The nanoparticles and the polymeric nanoparticle stabilizer, preferably form a "core-shell" structure in an aqueous medium, under alkaline conditions.

By "core-shell structure" is meant herein a central nuclei part (core) protected by a shield part (shell). The core can have any shape or geometry. The shell does not need to be a continuous layer, it suffices that the shell is capable of protecting the core from forming aggregates in the presence of hardness ions. Without wishing to be bound by theory, it is believed that the nanoparticle stabilizer adsorbs on the surface of the nanoparticle thereby making it stable with respect to water hardness ions. Again, without wishing to be bound by theory, it is believed that the nanoparticle and the nanoparticle stabilizer "coulombically interact" to form the core-shell structure. "Columbically interact" is used herein to include ionic interaction, hydrogen bonding and dipole-dipole interaction and it is to be distinguished from interactions which produce a covalent bond. It has been found that a dispersion having an excellent stability can be achieved by using nanoparticle stabilizers capable of forming hydrogen bonds with the nanoparticles.

The core shell structure of the composition of the invention has a zeta potential (as measured in 1% wt aqueous solution at 20° C.) of from about −10 to about −50 mV, more preferably from about −15 to about −45 mV and even more preferably from about −20 to about −30 and a particle size of from about 1 to about 500 nm, more preferably from about 5 to about 400 and more preferably from about 10 to about 200 nm and especially from about 20 to about 60 nm Aqueous compositions comprising core-shell structures having the claimed combination of size and zeta potential have been found to be outstanding in terms of first time cleaning, shine, second time cleaning and care (including metal and glass care), particularly on hard surfaces. Most of the hard surfaces, in particular the hard surfaces of dishware and tableware, are negatively charged. It could be expected that negatively charged nanoparticles would be repelled from the negatively charged surfaces. Surprisingly, this does not seem to be the case with the compositions of the invention.

The composition of the invention can be in any physical form, solid, liquid, gel, etc. Preferred for use herein is a compositions in solid form, for example powder, either loose powder or compressed powder. Preferably the composition of the invention is free of anionic surfactants.

In a preferred embodiment, the nanoparticle stabilizer comprises a moiety comprising at least one heteroatom selected from the group consisting of nitrogen, oxygen, sulphur or mixtures thereof. In a more preferred embodiment the moiety comprises a nitrogen-containing cyclic unit, more preferably a nitrogen heterocycle (i.e. a cyclic unit comprising nitrogen as part of it).

Nitrogen heterocycles are preferred for use herein. Preferred heterocycles are selected from azlactone, azlactam, more preferred heterocycles include pyrrolidone, imidazole, pyridine, pyridine-N-oxide, oxazolidone and mixtures thereof. Especially preferred polymers are polyvinyl imidazole, polyvinyl pyrrolidone, polyvinyl pyridine-N-oxide and mixtures thereof. Especially preferred are those polymers and copolymers wherein no optional anionic moiety (at pH of 10.5) is present.

In more detail, moieties containing a nitrogen heterocycle for use herein include but are not limited to: vinylpyridines such as 2-vinylpyridine or 4-vinylpyridine; lower alkyl ($C_1$-$C_8$) substituted N-vinylpyridines such as 2-methyl-5-vinylpyridine, 2-ethyl-5-vinylpyridine, 3-methyl-5-vinylpyridine, 2,3-dimethyl-5-vinylpyridine, and 2-methyl-3-ethyl-5-vinylpyridine; methyl-substituted quinolines and isoquinolines; N-vinylcaprolactam; N-vinylbutyrolactam; N-vinylpyrrolidone; vinyl imidazole; N-vinylcarbazole; N-vinylsuccinimide; maleimide; N-vinyl-oxazolidone; N-vinylphthalimide; N-vinylpyrrolidones such as N-vinylthiopyrrolidone, 3 methyl-1-vinylpyrrolidone, 4-methyl-1-vinylpyrrolidone, 5-methyl-1-vinylpyrrolidone, 3-ethyl-1-vinylpyrrolidone, 3-butyl-1-vinylpyrrolidone, 3,3-dimethyl-1-vinylpyrrolidone, 4,5-dimethyl-1-vinylpyrrolidone, 5,5-dimethyl-1-vinylpyrrolidone, 3,3,5-trimethyl-1-vinylpyrrolidone, 4-ethyl-1-vinylpyrrolidone, 5-methyl-5-ethyl-1-vinylpyrrolidone and 3,4,5-trimethyl-1-vinylpyrrolidone; vinylpyrroles; vinylanilines; and vinylpiperidines.

In a preferred embodiment, the nanoparticle stabilizer is a comb polymer comprising a backbone and pendant groups wherein the backbone comprises a moiety comprising nitrogen and the pendant groups are non-ionic.

Preferably the backbone comprises groups selected from one or more of alkylene amines, alkyl pyrrolidones and alkyl imidazoles or mixtures thereof.

Preferred pendant groups for use herein include moieties comprising alkoxylates, alkyl acetates and alkylene glycols. In particular, ethylene oxide, ethylene glycol, ethylene glycol dimethyl ether, ethylene glycol monomethyl ether, propylene oxide, propylene glycol, methyl methacrylate, vinyl alcohol, vinyl acetate, oxyethylene, vinyl methyl ether, and dimethylsiloxane, or mixtures thereof.

Especially preferred for use herein include comb polymers, the backbone comprises groups selected from one or more of alkylene amines, alkyl pyrrolidones and alkyl imidazoles or mixtures thereof and the pendant groups are selected from one or more of the group comprising alkyl acetates and alkylene glycols. Examples would include comb polymers wherein the backbone comprises vinylimidazole and/or vinylpyrrolidone units and the pendant groups are polyalkylene glycols, preferably polyethylene glycols. Preferably, the comb polymer comprises a plurality of different moieties, this increases the tolerance of the stabilizer to the medium.

Without wishing to be bound by theory it is believed that said pendant groups can provide enhanced charge and/or steric stabilization to the nanoparticles within the wash liquor thereby enabling strong performance across a wide range of water hardness.

In a preferred embodiment, the nanoparticles and the nanoparticle stabilizer are in a weight ratio of from about 1:0.5 to 1:5, and more preferably from about 1:1 to about 1:1.5. The level of polymeric nanoparticle stabilizer required to stabilize the nanoparticle in the presence of a certain amount of calcium seems to be lower than the level of polymeric builder required to bind that calcium.

In a preferred embodiment, the composition of the invention comprises a protease enzyme. Surprisingly, it has been found that the nanoparticle stabilizer avoids the negative interaction between this type of enzyme and the nanoparticles. This composition provides excellent proteinaceous cleaning.

The compositions of the invention provide an excellent cleaning even in the absence of traditional builders. Thus according to another embodiment of the invention, the composition comprises less than 10% by weight of the composition of phosphate builder, preferably less than 5% and more preferably less than 2%. This composition is excellent from an environmental viewpoint.

According to a second aspect of the present invention, there is provided a method of cleaning a soiled load (i.e., soiled housewares such as pots, pans, dished, cups, saucers, bottles, glassware, crockery, kitchen utensils, etc) in an automatic dishwasher, the method comprises the step of contacting the load with the compositions of the invention. The method of the invention is especially effective for tough food cleaning, including cooked-, baked- and burnt on soils. The method also provides second time benefits and excellent finishing and care, including glass care and metal care.

The method of the invention allows for the use of a wide range of nanoparticle concentrations. The concentration of nanoparticle in the wash liquor is preferably from about 50 ppm to about 2,500 ppm, more preferably from about 100 to about 2,000 and especially from about 200 to about 1,000 ppm.

It is also preferred that the composition comprises from about 2 to about 60%, more preferably from 5 to 50% by weight thereof of nanoparticles (or a nanoparticle precursor) and from about 2 to about 60%, more preferably from 5 to 50% by weight thereof of nanoparticle-protease compatibilizer. Preferably, the composition comprises an alkalinity source in a level of from about 1 to about 40%, more preferably from about 5 to about 35% by weight of the composition. Preferably, the composition comprises a source of univalent ions, in particular sodium or potassium hydroxide. Also preferred are compositions free of compounds which form insoluble calcium or magnesium salt, such as carbonates and silicates. Preferably the composition comprises a builder, more preferably a non-phosphate builder, in a level of from about 10 to about 60%, preferably from about 20 to 50% by weight of the composition.

DETAILED DESCRIPTION OF THE INVENTION

The present invention envisages a composition comprising nanoparticles (or a nanoparticle precursor) and a polymeric nanoparticle stabilizer, the invention also envisages a method of automatic dishwashing wherein the wash liquor comprises dispersed nanoparticles stabilized by a polymeric nanoparticle stabilizer. The method and composition provide excellent removal of tough food soils from cookware and tableware, in particular starchy and proteinaceous soils. Excellent results have been achieved when the dishwashing liquor comprises nanoclay as main soil removal active, either in absence of or in combination with other cleaning actives (such as enzymes, builders, surfactants, etc). This obviates or reduces the use of traditional dishwashing detergents. The compositions are preferably free of phosphate builders.

Nanoparticles

The nanoparticles of the composition of the invention are preferably inorganic nanoparticles. Preferred inorganic nanoparticles can be selected from the group comprising metal oxides, hydroxides, clays, oxy/hydroxides, silicates, phosphates and carbonates. Nanoparticles selected from the group consisting of metal oxides and clays are preferred for use herein. Examples include silicon dioxide, aluminium oxide, zirconium oxide, titanium dioxide, cerium oxide, zinc oxide, magnesium oxide, clays, tin oxide, iron oxides ($Fe_2O_3$, $Fe_3O_4$) and mixtures thereof.

In one aspect, the nanoparticles for use in the present invention are layered clay minerals (referred herein sometimes as clays). Suitable layered clay minerals include those in the geological classes of smectites, kaolins, illites, chlorites, attapulgites and mixed layer clays. Smectites, for example, include montmorillonite, bentonite, pyrophyllite, hectorite, saponite, sauconite, nontronite, talc, beidellite, volchonskoite and vermiculite. Kaolins include kaolinite, dickite, nacrite, antigorite, anauxite, halloysite, indellite and chrysotile. Mites include bravaisite, muscovite, paragonite, phlogopite and biotite. Chlorites include corrensite, penninite, donbassite, sudoite, pennine and clinochlore. Attapulgites include sepiolite and polygorskyte. Mixed layer clays include allevardite and vermiculitebiotite.

The layered clay minerals may be either naturally occurring or synthetic. Natural or synthetic hectorites, montmorillonites and bentonites are suitable for use herein, especially preferred for use herein are hectorites clays commercially available. Typical sources of commercial hectorites are the LAPONITES from Rockwood Additives Limited; Veegum Pro and Veegum F from R. T. Vanderbilt, U.S.A.; and the Barasyms, Macaloids and Propaloids from Baroid Division, National Read Comp., U.S.A.

Natural clay minerals which may be used typically exist as layered silicate minerals and less frequently as amorphous minerals. A layered silicate mineral has SiO tetrahedral sheets arranged into a two-dimensional network structure. A 2:1 type layered silicate mineral has a laminated structure of several to several tens of silicate sheets having a three layered structure in which a magnesium octahedral sheet or an aluminum octahedral sheet is sandwiched between two sheets of silica tetrahedral sheets.

Synthetic hectorite is commercially marketed under the trade name LAPONITE™ by Rockwood Additives Limited. There are many grades or variants and isomorphous substitutions of LAPONITE™ marketed. Examples of commercial hectorites are Lucentite SWN™, LAPONITE S™, LAPONITE XLS™, LAPONITE RD™, LAPONITE B™ and LAPONITE RDS™. Generally LAPONITE™ has the formula: $[Mg_wLi_xSi_8O_{20}OH_{4-y}F_y]^{z-}$ wherein w=3 to 6, x=0 to 3, y=0 to 4, z=12−2w−x, and the overall negative lattice charge may be balanced by counter-ions; and wherein the counter-ions are selected from the group consisting of Na+, K+, NH4+, Cs+, Li+, Mg++, Ca++, Ba++, N(CH3)4+ and mixtures thereof.

Preferred for use herein is the synthetic hectorite commercially available under the name Laponite® RD. Synthetic hectorites, have been found better for cleaning than other nanoparticles.

Clay nanoparticles (also referred herein as nanoclays) are charged crystals having a layered structure. The top and bottom of the crystals are usually negatively charged and the sides are positively charged, at alkaline pH. Due to the charged nature of nanoclays, they tend to aggregate in solution to form large structures that do not effectively contribute to cleaning. Moreover, these structures may deposit on the washed load, leaving an undesirable film on them. In particular, the nanoclays tend to aggregate in the presence of calcium and magnesium found in the wash water. A key requirement of the composition and method of the invention is the nanoclay to be dispersed in the wash liquor. By "dispersed" it is meant that the nanoclay is in the form of independent crystals, in particular the form of individual crystals having a particle size of from about 10 nm to about 300 nm, preferably from about 20 nm to about 100 nm and especially from about 30 to about 90 nm. The particle size of the crystals can be measured using a Malvern zetasizer instrument. The nanoclay particle size referred to herein is the z-average diameter, an intensity mean size.

Nanoparticle Stabilizer Determination

An aqueous solution containing 267 ppm of nanoparticles (Laponite™ RD) having a pH of 10.5 is prepared and the particle size measured (original particle size). An aqueous solution comprising 267 ppm of nanoparticles and 800 ppm, preferably 600 ppm, more preferably 400 ppm and especially 200 ppm of polymeric nanoparticle stabilizer having a pH of 10.5 is prepared, 50 ppm, preferably 100 ppm and more preferably 150 ppm of calcium is added to the solution and the particle size is measured (modified particle size).

The 267 ppm nanoparticle solution is prepared by adding 0.267 g of nanoparticles into 1 liter of deionised water with high agitation (600-1000 rpm) to avoid the formation of lumps, the pH is adjusted to 10.5 by using 1M NaOH solution. The solution is stirred for at least 30 mins and then put it into ultrasonic water bath for 30 mins to ensure that the nanoparticles have fully dispersed in deionised water.

The particle size of the nanoparticles in the nanoparticles containing solution (original particle size) is measured by using a Malvern zetasizer (Zetasizer Nano ZS). Settings of measurement: temperature 25° C., 5 replications, polysterene latex as material selected from refractive index, dispersant (water) viscosity selected as material viscosity, general purpose selected to calculate the result, and equilibrating time 2 mins.

A 4% by weight polymer solution is prepared by dissolving 0.4 g of polymer in 10 g of deionised water.

The solution comprising nanoparticles (267 ppm), polymer (800, preferably 600 ppm, more preferably 400 and especially 200 ppm) and calcium (50 ppm, preferably 100 ppm and more preferably 150 ppm) (modify particle size) is prepared by adding 2 ml, preferably 1.5 ml, more preferably 1 ml and especially 0.5 ml of the polymer solution to 98 ml, preferably 98.5 ml, more preferably 99 ml and especially 99.5 ml of the nanoparticle solution and then adding 0.020 g (preferably 0.037 g, more preferably 0.055 g) of $CaCl_2 2H_2O$. The pH is adjusted to 10.5 with 1M NaOH. The particle size of the particles of this solution (modify particle size) is measured using a Malvern Zetasizer (using the above settings).

The modified particle size is compared with the original. If the original particle size is less than 10, preferably less than 5, more preferably less than 3 and especially less than 2 times that of the original particle size, then the polymer is considered a nanoparticle stabilizer within the meaning of the invention.

Polymeric Nanoparticle Stabilizer

Suitable nanoparticle stabilizer polymers should have a molecular weight of from 500 to 1,000,000, more preferably from 1,000 to 200,000, especially 5,000 to 100,000.

Zeta Potential Measurement

The zeta potential is measured using the same equipment and settings as that used for particle size measurement. A Malvern zetasizer (Zetasizer Nano ZS) is used. The settings of measurement are: temperature 25° C., 5 replications, polysterene latex as material selected from refraction index, Smoluchowski model used for small particle in aqueous media, general purpose selected to calculate the result, and equilibrating time 2 mins. Best readings are obtained when the concentration of nanoparticle is 2000 ppm. The preparation of the solutions is similar to the solutions prepared to measure the particle size.

A composition that has been found to give excellent results comprises from about 2 to 60%, preferably from 5 to 50% by weight of the composition of nanoclay, from about 1 to about 40%, preferably from about 5 to about 35% by weight of the composition of an alkalinity source, from about 10 to about 60%, preferably from about 2 to about 50% by weight of the composition of a nanoparticle stabilizer (preferably a polymer comprising a nitrogen heterocycle), from about 5 to about 40%, preferably from about 10 to about 30% by weight of the composition of bleach and from about 0.5 to about 10%, preferably from about 0.01 to about 2% by weight of the composition of active enzyme.

Preferably the wash liquor has a pH of from about 9 to about 12, more preferably from about 10 to about 11.5 and an ionic strength of from about 0.001 to about 0.02, more preferably from about 0.002 to about 0.015, especially from about 0.005 to about 0.01 moles/l. The method provides excellent cleaning, in particular on starch containing soils and on proteinaceous soils. Heavily soiled items such as those containing burn-on, baked-on or cook-on starchy food such as pasta, rice, potatoes, wholemeal, sauces thickened by means of starchy thickeners, etc. are easily cleaned using the method of the invention.

Ionic Strength

Preferably the wash liquor in which the composition of the invention is used, has an ionic strength of from about 0.001 to about 0.02, more preferably from about 0.002 to about 0.015, especially form about 0.005 to about 0.01 moles/l.

Ionic strength is calculated from the molarity (m) of each ionic species present in solution and the charge (z) carried by each ionic species. Ionic strength (I) is one half the summation of $m \cdot z^2$ for all ionic species present i.e.

$$I = \tfrac{1}{2} \Sigma m \cdot z^2$$

For a salt whose ions are both univalent, ionic strength is the same as the molar concentration. This is not so where more than two ions or multiple charges are involved. For instance a 1 molar solution of sodium carbonate contains 2 moles/liter of sodium ions and 1 mole/liter of carbonate ions carrying a double charge. Ionic strength is given by:

$$I = \tfrac{1}{2}[2(1^2) + 1 \times (2^2)] = 3 \text{ moles/liter}$$

Alkalinity Source

Examples of alkalinity source include, but are not limited to, an alkali hydroxide, alkali hydride, alkali oxide, alkali sesquicarbonate, alkali carbonate, alkali borate, alkali salt of mineral acid, alkali amine, alkaloid and mixtures thereof. Sodium carbonate, sodium and potassium hydroxide are preferred alkalinity sources for use herein, in particular sodium hydroxide. The alkalinity source is present in an amount sufficient to give the wash liquor a pH of from about 9 to about 12, more preferably from about 10 to about 11.5. Preferably, the composition herein comprises from about 1% to about 40%, more preferably from about 2% to 20% by weight of the composition of alkaline source.

The wash liquor comprises an alkalinity source in an amount sufficient to give the wash liquor the desired pH. Preferably the wash liquor contains from about 20 to about 1,200 ppm, more preferably from about 100 to about 1,000 of an alkalinity source. It is especially preferred that the alkalinity source comprises a source of univalent ions. Univalent ions contribute to high alkalinity and at the same time hardly raise the ionic strength of the wash solution. Preferred alkalinity sources for use herein are metal hydroxides, in particular sodium or potassium hydroxide and especially sodium hydroxide.

Builder

Suitable builder to be used herein may be any builder known to those skilled in the art such as the ones selected from the group comprising phosphonates, amino carboxylates or other carboxylates, or polyfunctionally-substituted aromatic builders or mixtures thereof.

A preferred builder for use herein is a low molecular weight polyacrylate homopolymer, having a molecular weight of from about 1,000 to about 30,000, preferably from about 2,000 to about 20,000 and more preferably from about 3,000 to about 12,000. Another preferred dispersant for use herein is an aminocarboxylate, in particular MGDA (methyl glycine diacetic acid) and GLDA (glutamic acid-N,N-diacetate).

In other preferred embodiments the builder is a mixture of a low molecular weight polyacrlyate homopolymer and another builder, in particular an amino polycarboxylate builder. It has been found that the combination of low molecular weight polyacrylates with amino polycarboxylates is very good in terms of soil removal. MGDA and GLDA have been found most suitable amino polycarboxylates for use herein.

Phosphonate suitable for use herein may include etidronic acid (1-hydroxyethylidene-bisphosphonic acid or HEDP) as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonates to be used herein are diethylene triamine penta methylene phosphonates. Such phosphonates are commercially available from Monsanto under the trade name DEQUEST®.

Polyfunctionally-substituted aromatics may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

Suitable amino carboxylates for use herein include nitrilotriacetates (NTA), ethylene diamine tetra acetate (EDTA), diethylene triamine pentacetate (DTPA), N-hydroxyethylethylenediamine triacetate, nitrilotri-acetate, ethylenediamine tetraproprionate, triethylenetetraaminehexa-acetate (HEDTA), triethylenetetraminehexaacetic acid (TTHA), propylene diamine tetracetic acid (PDTA) and, both in their acid form, or in their alkali metal salt forms. Particularly suitable to be used herein are diethylene triamine penta acetic acid (DTPA) and propylene diamine tetracetic acid (PDTA). A wide range of aminocarboxylates is commercially available from BASF under the trade name Trilon®. A preferred biodegradable amino carboxylate for use herein is ethylene diamine N,N'-disuccinic acid (EDDS), or alkali metal or alkaline earth salts thereof or mixtures thereof. Ethylenediamine N,N'-disuccinic acids, especially the (S,S) isomer have been extensively described in U.S. Pat. No. 4,704,233, Nov. 3, 1987 to Hartman and Perkins. Ethylenediamine N,N'-disuccinic acid is, for instance, commercially available under the tradename ssEDDS® from Palmer Research Laboratories.

Aminodicarboxylic acid-N,N-dialkanoic acid or its salt are also suitable amino carboxylates for use herein. The compounds can be represented by the following formula:

$$MOOC—CHZ^1—NZ^2Z^3$$

wherein each of $Z^1$, $Z^2$ and $Z^3$ independently represents a COOM-containing group; wherein each of M independently represents either of a hydrogen atom, sodium, potassium or amine ion.

In the above formula, $Z^1$, $Z^2$ and $Z^3$ may either be same with or different from each other, and examples of those groups are found among carboxymethyl group, 1-carboxyethyl group, 2-carboxyethyl group, 3-carboxypropan-2-yl group, their salts, etc. As concrete examples, there are glutamic acid-N,N-diacetic acid, glutamic acid-N,N-dipropionic acid, and their salts. Above all, glutamic acid-N,N-diacetate is especially preferred, in particular L-glutamic acid-N,N-diacetate.

Other suitable builders include ethanoldiglycine and methyl glycine di-acetic acid (MGDA).

Further carboxylates useful herein include low molecular weight hydrocarboxylic acids, such as citric acid, tartaric acid malic acid, lactic acid, gluconic acid, malonic acid, salicylic acid, aspartic acid, glutamic acid, dipicolinic acid and derivatives thereof, or mixtures thereof.

Suitable carboxylated polymers include polymeric polycarboxylated polymers, including homopolymers and copolymers. Preferred for use herein are low molecular weight (from about 2,000 to about 30,000, preferably from about 3,000 to about 20,000) homopolymers of acrylic acid. They are commercially available from BASF under the Sokalan PA range. An especially preferred material is Sokalan PA 30. Sodium polyacrylate having a nominal molecular weight of about 4,500, is obtainable from Rohm & Haas under the tradename ACUSOL® 445N. Other polymeric polycarboxylated polymers suitable for use herein include copolymers of acrylic acid and maleic acid, such as those available from BASF under the name of Sokalan CP and AQUALIC® ML9 copolymers (supplied by Nippon Shokubai Co. LTD).

Other suitable polymers for use herein are polymers containing both carboxylate and sulphonate monomers, such as ALCOSPERSE® polymers (supplied by Alco) and Acusol 588 (supplied by Rohm & Hass).

With reference to the polymers described herein, the term weight-average molecular weight (also referred to as molecular weight) is the weight-average molecular weight as determined using gel permeation chromatography according to the protocol found in Colloids and Surfaces A. Physico Chemical & Engineering Aspects, Vol. 162, 2000, pg. 107-121. The units are Daltons.

If present, the composition of the invention comprises from about 5 to about 40%, more preferably from about 10 to about 30% by weight of the composition of a builder. Preferably the composition is free of phosphate builder.

Other Cleaning Actives

Any traditional cleaning ingredients can be used in the composition and method of the invention.

Bleach

Inorganic and organic bleaches are suitable cleaning actives for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate are preferred perhydrates for use herein. The percarbonate is most preferably incorporated into the products in a coated form which provides in-product stability. A suitable coating material providing in product stability comprises mixed salt of a water-soluble alkali metal sulphate and carbonate. Such coatings together with coating processes have previously been described in GB-1,466,799. The weight ratio of the mixed salt coating material to percarbonate lies in the range from 1:200 to 1:4, more preferably from 1:99 to 1 9, and most preferably from 1:49 to 1:19. Preferably, the mixed salt is of sodium sulphate and sodium carbonate which has the general formula Na2S04.n.Na2CO3 wherein n is from 0.1 to 3, preferably n is from 0.3 to 1.0 and most preferably n is from 0.2 to 0.5.

Another suitable coating material providing in product stability, comprises sodium silicate of Si02:Na20 ratio from 1.8:1 to 3.0:1, preferably L8:1 to 2.4:1, and/or sodium metasilicate, preferably applied at a level of from 2% to 10%, (normally from 3% to 5%) Of Si02 by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradec anedioc acid, and diperoxyhexadecanedioc acid. Dibenzoyl peroxide is a preferred organic peroxyacid herein. Mono- and diperazelaic acid, mono- and diperbrassylic acid, and Nphthaloylaminoperoxicaproic acid are also suitable herein.

The diacyl peroxide, especially dibenzoyl peroxide, should preferably be present in the form of particles having a weight average diameter of from about 0.1 to about 100 microns, preferably from about 0.5 to about 30 microns, more preferably from about 1 to about 10 microns. Preferably, at least about 25%, more preferably at least about 50%, even more preferably at least about 75%, most preferably at least about 90%, of the particles are smaller than 10 microns, preferably smaller than 6 microns. Diacyl peroxides within the above particle size range have also been found to provide better stain removal especially from plastic dishware, while minimizing undesirable deposition and filming during use in automatic dishwashing machines, than larger diacyl peroxide particles. The preferred diacyl peroxide particle size thus allows the formulator to obtain good stain removal with a low level of diacyl peroxide, which reduces deposition and filming. Conversely, as diacyl peroxide particle size increases, more diacyl peroxide is needed for good stain removal, which increases deposition on surfaces encountered during the dishwashing process.

Further typical organic bleaches include the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

If present, the composition of the invention comprises from about 5 to about 40%, more preferably from about 10 to about 30% by weight of the composition of a bleach. Preferably the composition comprises percarbonate bleach.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.1 to about 10%, preferably from about 0.5 to about 2% by weight of the composition.

Bleach Catalyst

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16. Bleach catalyst if included in the compositions of the invention are in a level of from about 0.1 to about 10%, preferably from about 0.5 to about 2% by weight of the composition.

Surfactant

Preferably the compositions (methods and products) for use herein are free of surfactants. A preferred surfactant for use herein is low foaming by itself or in combination with other components (i.e. suds suppressers). Preferred for use herein are low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include lauryldimethyl amine oxide and hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of a detergent composition. Preferred surfactant for use herein, if any, are low foaming and include low cloud point nonionic surfactants and mixtures of higher foaming surfactants with low cloud point nonionic surfactants which act as suds suppresser therefor.

Enzyme

Suitable proteases include metalloproteases and serine proteases, including neutral or alkaline microbial serine proteases, such as subtilisins (EC 3.4.21.62). Suitable proteases include those of animal, vegetable or microbial origin. Microbial origin is preferred. Chemically or genetically modified mutants are included. The protease may be a serine protease, preferably an alkaline microbial protease or a chymotrypsin or trypsin-like protease. Examples of neutral or alkaline proteases include:

(a) subtilisins (EC 3.4.21.62), especially those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, DEA6022216 A1 and DEA 6022224A1.

(b) trypsin-like or chymotrypsin-like proteases, such as trypsin (e.g., of porcine or bovine origin), the Fusarium protease described in WO 89/06270 and the chymotrypsin proteases derived from Cellumonas described in WO 05/052161 and WO 05/052146.

(c) metalloproteases, especially those derived from *Bacillus amyloliquefaciens* decribed in WO 07/044993A2.

Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novo Nordisk A/S (Denmark), those sold under the tradename Maxatase®, Maxacal®, Maxapem®, Properase®, Purafect®, Purafect Prime®, Purafect Ox®, FN3®, FN4® and Purafect OXP® by Genencor International, and those sold under the tradename Opticlean® and Optimase® by Solvay Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484 that also preferably contain the deletions of D183* and G184*.

(c) variants exhibiting at least 90% identity with SEQ ID No. 4 in WO06/002643, the wild-type enzyme from Bacillus SP722, especially variants with deletions in the 183 and 184 positions and variants described in WO 00/60060, which is incorporated herein by reference.

Suitable commercially available alpha-amylases are DURAMYL®, LIQUEZYME® TERMAMYL®, TERMAMYL ULTRA®, NATALASE®, SUPRAMYL®, STAINZYME®, STAINZYME PLUS®, FUNGAMYL® and BAN® (Novozymes A/S), BIOAMYLASE-D(G), BIOAMYLASE® L (Biocon India Ltd.), KEMZYM® AT 9000 (Biozym Ges. m.b.H, Austria), RAPIDASE®, PURASTAR®, OPTISIZE HT PLUS® and PURASTAR OXAM® (Genencor International Inc.) and KAM® (KAO, Japan). In one aspect, preferred amylases are NATALASE®, STAINZYME® and STAINZYME PLUS® and mixtures thereof.

Enzymes are preferably added herein as prills, granulates, or cogranulates at levels typically in the range from about 0.0001% to about 5%, more preferably from about 0.001% to about 2% pure enzyme by weight of the cleaning composition. Preferred for use herein are proteases, amylases and in particular combinations thereof.

Low Cloud Point Non-Ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360-362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Preferred low cloud point surfactants are the ether-capped poly(oxyalkylated) suds suppresser having the formula:

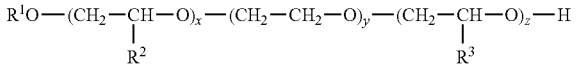

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

The nanoparticles can negatively interact with some cleaning actives either in the wash liquor. In preferred embodiments of the method of the invention, there is a delayed release of the nanoparticles with respect to other ingredients. This ameliorates negative interactions and improves cleaning performance. By "delayed release" is meant that at least 50%, preferably at least 60% and more preferably at least 80% of one of the components is delivered into the wash solution at least one minute, preferably at least two minutes and more preferably at least 3 minutes, than at less than 50%, preferably less than 40% of the other component. The nanoparticle can be delivered first and the enzyme second or vice-versa. Good cleaning results are obtained when the enzyme, in particular protease, is delivered first and the nanoclay second. Delayed release can be achieved by for example using a multi-compartment pouch wherein different compartments have different dissolution rates, by having multi-phase tablets where different phases dissolve at different rates, having coated bodies, layered particles, etc.

Water-Soluble Pouch

In a preferred embodiment of the present invention the detergent composition is in the form of a water-soluble pouch, more preferably a multi-phase unit dose pouch, preferably an injection-moulded, vacuum- or thermoformed multi-compartment, wherein at least one of the phases comprises the nanoparticles. Preferred manufacturing methods for unit dose executions are described in WO 02/42408 and EP 1,447,343 B1. Any water-soluble film-forming polymer which is compatible with the compositions of the invention and which allows the delivery of the composition into the main-wash cycle of a dishwasher can be used as enveloping material.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

Delayed Release

Delayed release can be achieved by means of coating, either by coating active materials or particle containing active material. The coating can be temperature, pH or ionic strength sensitive. For example particles with a core comprising either nanoparticles (or a nanoparticle precursor) or enzyme and a waxy coating encapsulating the core are adequate to provide delayed release. For waxy coating see WO 95/29982. pH controlled release means are described in WO 04/111178, in particular amino-acetylated polysaccharide having selective degree of acetylation.

Other means of obtaining delayed release are pouches with different compartments, where the compartments are made of film having different solubilities (as taught in WO 02/08380).

Delayed release can also be obtained by layering of actives in solid particles as described in WO2007/146491.

In the case of free builder formulations it has been found that an improved cleaning can be obtained by delivering enzymes and an alkalinity source to the wash liquor, followed by bleach and then the nanoparticles and the nanoparticle stabilizer. In the case of build compositions it has been found that an improved cleaning is obtained if the builder and alkalinity source are delivered first, followed by enzymes then nanoparticle stabilizer and finally nanoparticles.

In the case in which the cleaning composition comprises layered particles comprising different actives in different layers, it has been found that excellent cleaning is provided by particles comprising nanoparticles in the core of the particle, this allows for delayed release of the nanoparticles into the wash liquor.

EXAMPLES

Abbreviations Used in Examples

In the examples, the abbreviated component identifications have the following meanings:

MGDA Disolvine GL (tetrasodim N,N-bis(carboxylato methyl-L-glutamate) from Azko Nobel GLDA Glutamic-N,N-diacetic acid STPP Sodium tripolyphosphate anhydrous KOH Potassium Hydroxide Sodium Anhydrous sodium carbonate Carbonate Laponite Laponite® RD synthetic hectorite available from Rockwood Additives Limited.

Polymer Polyvinylpirrolidone vinylimidazole/polyethylene glycol copolymer

PA30 Polyacrylic acid available from BASF

Percarbonate Sodium percarbonate of the nominal formula $2Na_2CO_3.3H_2O_2$

TAED Tetraacetylethylenediamine

Bleach catalyst Cobalt bleach catalyst

Protease Protease PX available from Novozymes

Amylase Stainzyme Plus available from Novozymes

In the following examples all levels are quoted as parts by weight of the composition.

Example 1 and 5 illustrate the use of compositions comprising a synthetic clay, Laponite®, for the removal of different types of soil in a dishwasher. The dishwasher load comprises different soils and different substrates: Macaroni & Cheese on stainless steel baked for 7 minutes at 200° C., scrambled eggs on ceramic bowls microwaved for 2 minutes, cooked rice on ceramic dishes, scrambled eggs on stainless steel slides and cooked pasta on glass slides. The dishware is allowed to dry for 12 hours and then is ready to use. The dishware is loaded in a dishwasher (i.e GE Model GSD4000, Normal Wash at 50° C.).

The cleaning was excellent in all cases.

| 100% activity | Example 1 | Example 2 | Example 3 | Example 4 | Example 5 |
|---|---|---|---|---|---|
| MGDA | 0 | 13% | 0 | 0 | 9.5% |
| GLDA | 0 | 0 | 15.8% | 0 | 0 |
| STPP | 0 | 0 | 0 | 25.9% | 0 |
| NaOH | 6.0% | 5.2% | 5% | 0 | 0 |
| Sodium Carbonate | 0 | 0 | 0 | 18.9% | 26.7% |
| Laponite | 23.9% | 20.8% | 20.1% | 14.0% | 15.3% |
| Polymer | 31.7% | 27.6% | 26.7% | 18.6% | 20.2% |
| PA30 | 0 | 0 | 0 | 0 | 3.81% |
| Percarbonate | 26.3% | 22.9% | 22.2% | 15.4% | 16.8% |
| TAED | 7.2% | 6.2% | 6.0% | 4.21% | 4.58% |
| Catalyst | 0.02% | 0.017% | 0.017% | 0.012% | 0.013% |

-continued

| 100% activity | Example 1 | Example 2 | Example 3 | Example 4 | Example 5 |
|---|---|---|---|---|---|
| Protease | 2.4% | 2.08% | 2.01% | 1.40% | 1.53% |
| Amylase | 2.0% | 1.77% | 1.71% | 1.19% | 1.30% |
| Perfume | 0.48% | 0.42% | 0.40% | 0.28% | 0.31% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

SEQUENCE LISTING

```
<160> NUMBER OF SEQ ID NOS: 2

<210> SEQ ID NO 1
<211> LENGTH: 523
<212> TYPE: PRT
<213> ORGANISM: Bacillus amyloliquefaciens

<400> SEQUENCE: 1

Val Arg Ser Lys Lys Leu Trp Ile Ser Leu Leu Phe Ala Leu Thr Leu
1               5                   10                  15

Ile Phe Thr Met Ala Phe Ser Asn Met Ser Ala Gln Ala Ala Glu Asn
            20                  25                  30

Pro Gln Leu Lys Glu Asn Leu Thr Asn Phe Val Pro Lys His Ser Leu
        35                  40                  45

Val Gln Ser Glu Leu Pro Ser Val Ser Asp Lys Ala Ile Lys Gln Tyr
    50                  55                  60

Leu Lys Gln Asn Gly Lys Val Phe Lys Gly Asn Pro Ser Glu Arg Leu
65                  70                  75                  80

Lys Leu Ile Asp Gln Thr Thr Asp Asp Leu Gly Tyr Lys His Phe Arg
                85                  90                  95

Tyr Val Pro Val Val Asn Gly Val Pro Val Lys Asp Ser Gln Val Ile
            100                 105                 110

Ile His Val Asp Lys Ser Asn Asn Val Tyr Ala Ile Asn Gly Glu Leu
        115                 120                 125

Asn Asn Asp Val Ser Ala Lys Thr Ala Asn Ser Lys Lys Leu Ser Ala
    130                 135                 140

Asn Gln Ala Leu Asp His Ala Tyr Lys Ala Ile Gly Lys Ser Pro Glu
145                 150                 155                 160

Ala Val Ser Asn Gly Thr Val Ala Asn Lys Asn Lys Ala Glu Leu Lys
                165                 170                 175

Ala Ala Ala Thr Lys Asp Gly Lys Tyr Arg Leu Ala Tyr Asp Val Thr
            180                 185                 190

Ile Arg Tyr Ile Glu Pro Glu Pro Ala Asn Trp Glu Val Thr Val Asp
        195                 200                 205

Ala Glu Thr Gly Lys Ile Leu Lys Lys Gln Asn Lys Val Glu His Ala
    210                 215                 220

Ala Thr Thr Gly Thr Gly Thr Thr Leu Lys Gly Lys Thr Val Ser Leu
225                 230                 235                 240

Asn Ile Ser Ser Glu Ser Gly Lys Tyr Val Leu Arg Asp Leu Ser Lys
```

```
                245                 250                 255

Pro Thr Gly Thr Gln Ile Ile Thr Tyr Asp Leu Gln Asn Arg Glu Tyr
            260                 265                 270

Asn Leu Pro Gly Thr Leu Val Ser Ser Thr Thr Asn Gln Phe Thr Thr
        275                 280                 285

Ser Ser Gln Arg Ala Ala Val Asp Ala His Tyr Asn Leu Gly Lys Val
    290                 295                 300

Tyr Asp Tyr Phe Tyr Gln Lys Phe Asn Arg Asn Ser Tyr Asp Asn Lys
305                 310                 315                 320

Gly Gly Lys Ile Val Ser Ser Val His Tyr Gly Ser Arg Tyr Asn Asn
                325                 330                 335

Ala Ala Trp Ile Gly Asp Gln Met Ile Tyr Gly Asp Gly Asp Gly Ser
            340                 345                 350

Phe Phe Ser Pro Leu Ser Gly Ser Met Asp Val Thr Ala His Glu Met
        355                 360                 365

Thr His Gly Val Thr Gln Glu Thr Ala Asn Leu Asn Tyr Glu Asn Gln
    370                 375                 380

Pro Gly Ala Leu Asn Glu Ser Phe Ser Asp Val Phe Gly Tyr Phe Asn
385                 390                 395                 400

Asp Thr Glu Asp Trp Asp Ile Gly Glu Asp Ile Thr Val Ser Gln Pro
                405                 410                 415

Ala Leu Arg Ser Leu Ser Asn Pro Thr Lys Tyr Gly Gln Pro Asp Asn
            420                 425                 430

Phe Lys Asn Tyr Lys Asn Leu Pro Asn Thr Asp Ala Gly Asp Tyr Gly
        435                 440                 445

Gly Val His Thr Asn Ser Gly Ile Pro Asn Lys Ala Ala Tyr Asn Thr
    450                 455                 460

Ile Thr Lys Ile Gly Val Asn Lys Ala Glu Gln Ile Tyr Tyr Arg Ala
465                 470                 475                 480

Leu Thr Val Tyr Leu Thr Pro Ser Ser Thr Phe Lys Asp Ala Lys Ala
                485                 490                 495

Ala Leu Ile Gln Ser Ala Arg Asp Leu Tyr Gly Ser Gln Asp Ala Ala
            500                 505                 510

Ser Val Glu Ala Ala Trp Asn Ala Val Gly Leu
        515                 520


<210> SEQ ID NO 2
<211> LENGTH: 274
<212> TYPE: PRT
<213> ORGANISM: Bacillus Licheniformis

<400> SEQUENCE: 2

Ala Gln Thr Val Pro Tyr Gly Ile Pro Leu Ile Lys Ala Asp Lys Val
1               5                   10                  15

Gln Ala Gln Gly Phe Lys Gly Ala Asn Val Lys Val Ala Val Leu Asp
            20                  25                  30

Thr Gly Ile Gln Ala Ser His Pro Asp Leu Asn Val Val Gly Gly Ala
        35                  40                  45

Ser Phe Val Ala Gly Glu Ala Tyr Asn Thr Asp Gly Asn Gly His Gly
    50                  55                  60

Thr His Val Ala Gly Thr Val Ala Ala Leu Asp Asn Thr Thr Gly Val
65                  70                  75                  80

Leu Gly Val Ala Pro Ser Val Ser Leu Tyr Ala Val Lys Val Leu Asn
                85                  90                  95

Ser Ser Gly Ser Gly Thr Tyr Ser Gly Ile Val Ser Gly Ile Glu Trp
```

-continued

```
            100                 105                 110

Ala Thr Thr Asn Gly Met Asp Val Ile Asn Met Ser Leu Gly Gly Pro
        115                 120                 125

Ser Gly Ser Thr Ala Met Lys Gln Ala Val Asp Asn Ala Tyr Ala Arg
    130                 135                 140

Gly Val Val Val Val Ala Ala Ala Gly Asn Ser Gly Ser Ser Gly Asn
145                 150                 155                 160

Thr Asn Thr Ile Gly Tyr Pro Ala Lys Tyr Asp Ser Val Ile Ala Val
                165                 170                 175

Gly Ala Val Asp Ser Asn Ser Asn Arg Ala Ser Phe Ser Ser Val Gly
            180                 185                 190

Ala Glu Leu Glu Val Met Ala Pro Gly Ala Gly Val Tyr Ser Thr Tyr
        195                 200                 205

Pro Thr Ser Thr Tyr Ala Thr Leu Asn Gly Thr Ser Met Ala Ser Pro
    210                 215                 220

His Val Ala Gly Ala Ala Ala Leu Ile Leu Ser Lys His Pro Asn Leu
225                 230                 235                 240

Ser Ala Ser Gln Val Arg Asn Arg Leu Ser Ser Thr Ala Thr Tyr Leu
                245                 250                 255

Gly Ser Ser Phe Tyr Tyr Gly Lys Gly Leu Ile Asn Val Glu Ala Ala
            260                 265                 270

Ala Gln
```

What is claimed is:

1. An alkaline cleaning composition for use in an aqueous medium comprising clay nanoparticles or a nanoparticle precursor, from about 0.01% to about 2% by weight of a protease enzyme, and from about 10 to 50% by weight of a polymeric nanoparticle stabilizer; wherein said nanoparticles and said polymeric nanoparticle stabilizer form a core-shell structure in aqueous solution and wherein the nanoparticle stabilizer is a comb polymer comprising a backbone and pendant groups wherein the backbone comprises a moiety comprising nitrogen and the pendant groups are non-ionic, or the nanoparticle stabilizer comprises a moiety comprising at least one heteroatom selected from the group consisting of nitrogen, oxygen, sulphur and mixtures thereof.

2. An alkaline cleaning composition according to claim 1, wherein the core-shell structure has a size of from about 20 to about 200 nm and a zeta potential of from about −5 mV to about −40 mV.

3. The cleaning composition according to claim 1 comprising clay nanoparticles.

4. A cleaning composition according to claim 1, wherein the clays are synthetic clays.

5. A cleaning composition according to claim 1, wherein the moiety comprises a nitrogen-containing cyclic unit.

6. A cleaning composition according to claim 5, wherein the nitrogen-containing cyclic unit is a nitrogen heterocycle.

7. A cleaning composition according to claim 1, wherein the nanoparticles and the nanoparticle stabilizer are in a weight ratio of from about 1:0.5 to 1:5.

8. A cleaning composition according to claim 1, further comprising less than 10% by weight of the composition of builder.

9. A cleaning composition according to claim 1, wherein the polymeric nanoparticle stabilizer is present in an amount from about 10 to about 40% by weight of the composition.

10. A cleaning composition according to claim 1, wherein the protease enzyme is a serine protease.

11. A cleaning composition according to claim 1, wherein the cleaning composition is contained in a water soluble pouch.

12. A cleaning composition according to claim 1, further comprising a nonionic surfactant.

13. A cleaning composition according to claim 1, wherein said cleaning composition is substantially free of phosphate.

14. A cleaning composition according to claim 1, further comprising a source of alkalinity.

15. A cleaning composition according to claim 14, wherein the source of alkalinity is sodium carbonate.

16. A cleaning composition according to claim 1, further comprising polymers containing both carboxylate and sulphonate monomers.

17. A method of cleaning glassware/tableware in an automatic dishwashing machine comprising the step of contacting the glassware/tableware with a wash liquor comprising a composition according to claim 1, wherein the wash liquor comprises from about 50 to about 1,000 ppm of nanoparticles.

* * * * *